US005904160A

United States Patent [19]

Wright

[11] Patent Number: 5,904,160

[45] Date of Patent: May 18, 1999

[54] METHOD OF REMOVING LINT FROM CLOTHES DRYERS USING A MAGNETICALLY MOUNTABLE HAND HELD VACUUM CLEANER

[76] Inventor: Shari L. Wright, 5344 W. Voltaire Dr., Glendale, Ariz. 85304

[21] Appl. No.: 08/778,504

[22] Filed: Jan. 3, 1997

[51] Int. Cl.[6] ..... A47L 7/02

[52] U.S. Cl. ..... 134/21; 15/339; 15/344; 15/347; 15/352

[58] Field of Search ..... 134/21; 15/344, 15/352, 347, 339

[56] References Cited

U.S. PATENT DOCUMENTS

| | | | |
|---|---|---|---|
| 3,267,510 | 8/1966 | Cote | 15/344 |
| 3,513,500 | 5/1970 | Hori | 15/344 |
| 3,695,006 | 10/1972 | Valbona et al. | 55/274 |
| 4,011,624 | 3/1977 | Proett | 15/344 |
| 4,279,745 | 7/1981 | Haase | 209/215 |
| 4,300,260 | 11/1981 | Hill | 15/339 |
| 4,536,694 | 8/1985 | McCarty et al. | 320/2 |
| 4,598,439 | 7/1986 | Good | 15/339 |
| 4,635,315 | 1/1987 | Kozak | 15/329 |
| 4,704,765 | 11/1987 | Atake | 15/323 |
| 4,763,382 | 8/1988 | Sumerau | 15/323 |
| 4,918,857 | 4/1990 | Wade et al. | 15/402 |
| 4,934,020 | 6/1990 | Jackson | 15/339 |
| 5,005,252 | 4/1991 | Steiner et al. | 15/339 |
| 5,029,359 | 7/1991 | Ortega | 15/344 |
| 5,052,074 | 10/1991 | Korsen | 15/339 |
| 5,065,473 | 11/1991 | Krasznai et al. | 15/344 |
| 5,119,280 | 6/1992 | Yang | 362/191 |
| 5,153,965 | 10/1992 | Prosser et al. | 15/352 |
| 5,179,756 | 1/1993 | Korsen | 15/246 |
| 5,392,490 | 2/1995 | Monson | 15/344 |
| 5,533,230 | 7/1996 | Roude | 15/339 |
| 5,535,478 | 7/1996 | Thompson | 15/401 |

*Primary Examiner*—Jill Warden
*Assistant Examiner*—Sharidan Carrillo
*Attorney, Agent, or Firm*—Tod R. Nissle, P.C.

[57] ABSTRACT

A vacuum cleaner and method for facilitating the removal of lint from the lint screen of a clothes dryer without requiring that the lint screen be removed from the dryer. The vacuum cleaner includes an elongate housing, a nose attached to the housing and shaped and dimensioned to extend into the lint gathering recess to remove lint therefrom; an air permeable collecting apparatus for capturing lint in the housing; a vent; a fan for directing air through the nose into and through the air permeable collecting apparatus and for directing exhaust air out through the vent; and a magnet on said elongate housing for removably attaching the vacuum cleaner to a metal housing of the clothes dryer.

2 Claims, 3 Drawing Sheets

METHOD OF REMOVING LINT FROM CLOTHES DRYERS USING A MAGNETICALLY MOUNTABLE HAND HELD VACUUM CLEANER

BACKGROUND OF THE INVENTION

1. Field of the Invention

This invention relates to vacuum cleaners.

More particularly, the invention pertains to a vacuum cleaner especially adapted to facilitate the ready removal of lint from the lint screen of a clothes dryer.

In a further respect, the invention pertains to a vacuum cleaner which permits removal of lint from a clothes dryer lint screen without requiring that the lint screen be removed from the dryer.

2. Description of the Related Art including information disclosed under 37 CFR 1.97 to 1.99.

Clothes dryers continually produce lint which must be removed from a lint screen recess in the clothes dryer. The lint is removed either by removing the screen from the dryer and removing the lint or by manually scraping the lint off the screen while the screen remains in the dryer. Both of these methods of removing lint have long been successfully utilized by individuals after clothes have been dried in a dryer. A principal disadvantage of these conventional methods of removing lint from a drier screen is that some lint invariably falls to the floor, or escapes into the air while the lint screen is being cleaned. Although lint appears innocuous and harmless, lint fibers which are inhaled can irritate the lungs, increasing the risk that an individual will damage sensitive lung tissue. The heat generated by a drier tends to embrittle certain fibers, making them more likely to cut and irritate alveolar sacs, resulting in obstructive and infectious lung diseases. Further, the circulation of lint throughout a residence blocks filters and tends to shorten the useful life of various tools and machines which draw in air during operation.

A variety of vacuums are known in the art, ranging from large conventional HOOVER (Trademark) upright push vacuums for cleaning carpeting to small hand held DUST BUSTER (Trademark) vacuums for cleaning small spills. None of these existing vacuums is equipped to remove readily lint from the screen of a clothes dryer. One disadvantage of many existing vacuums is that they are too bulky and are too time consuming and impractical to move to a clothes dryer and plug in order to remove lint. While a homeowner may utilize a large upright HOOVER vacuum cleaner to vacuum the rugs in a home, the homeowner will not take the time to move the upright vacuum near a clothes dryer, to hook up the wand attachment, and to attempt to remove lint from the dryer's lint screen. For one thing, the wand and hose attached to the wand make utilization of the wand in the door of a clothes dryer awkward. Similarly, the smaller hand held DUSTBUSTER type of vacuums are impractical because the opening at the mouth of the vacuum can readily clog with lint. In addition, the nose of a DUSTBUSTER and the wand on a conventional vacuum both are not shaped and dimensioned to conform to the screen and opening in a clothes dryer lint catcher. The prior art does not appear to have considered utilizing a vacuum to facilitate the removal of lint from a clothes dryer lint screen.

Accordingly, it would be highly desirable to provide an improved vacuum cleaner to facilitate the removal of lint generated by a clothes dryer.

Therefore, it is a principal object of the invention to provide an improved vacuum cleaner.

A further object of the invention is to provide an improved vacuum cleaner which facilitates the convenient, ready removal of lint from the lint catching screen of a clothes dryer.

Another object of the invention is to provide an improved vacuum cleaner which fits into the front circular opening of a clothes dryer and can access the recessed lint screen at the lower part of the front circular opening in order to remove lint from the recessed lint screen.

Still a further object of the invention is to provide an improved vacuum cleaner which can suction lint through the mouth of the vacuum cleaner without allowing the lint to block the vacuum cleaner mouth.

Yet another object of the invention is to provide an improved vacuum cleaner which is instantly available to remove lint from the lint screen of a dryer.

BRIEF DESCRIPTION OF THE DRAWINGS

These and other, further and more specific objects and advantages of the invention will be apparent to those skilled in the art from the following detailed description thereof, taken in conjunction with the drawings, in which.

SUMMARY OF THE INVENTION

Briefly, in accordance with the invention, I provide an improved vacuum cleaner for removing lint from the lint screen of a clothes dryer. The vacuum cleaner includes an elongate housing; a nose attached to the housing; air permeable collecting apparatus for capturing lint in the housing; a vent; a fan for drawing air through the nose, into and through the collecting apparatus, and for directing exhaust air out through the vent; and, a magnet on the housing for securing the housing to a ferrous metal.

In another embodiment of my invention, I provide a vacuum cleaner for removing lint from the lint gathering recess of a clothes dryer. The vacuum cleaner includes an elongate housing; a nose attached to the housing and shaped and dimensioned to extend into the lint gathering recess to remove lint therefrom; air permeable collecting apparatus for capturing lint in the housing; a vent; a fan for drawing air through the nose, into and through the collection apparatus, and for directing exhaust air out through the vent; and, a magnet on the housing for securing the housing to a ferrous metal.

In a further embodiment of the invention, I provide a method for removing lint from the lint gathering recess of a clothes dryer. The method includes the step of providing a lint vacuum cleaner including an elongate housing; a nose attached to the housing and shaped and dimensioned to extend into the lint gathering recess to remove lint therefrom; air permeable collection apparatus for capturing lint in the housing; a vent; a fan for drawing air through the nose, into and through the collection apparatus, and for directing exhaust air out through the vent; and, apparatus for removably mounting the lint vacuum cleaner on a clothes dryer. The method also includes the steps of removably mounting the lint vacuum cleaner in a storage location on a selected clothes dryer; and, when necessary, removing the lint vacuum cleaner from the storage location and operating the lint vacuum cleaner to remove lint from the lint gathering recess of the selected clothes dryer.

DESCRIPTION OF THE PREFERRED EMBODIMENT(S)

Figure 1:
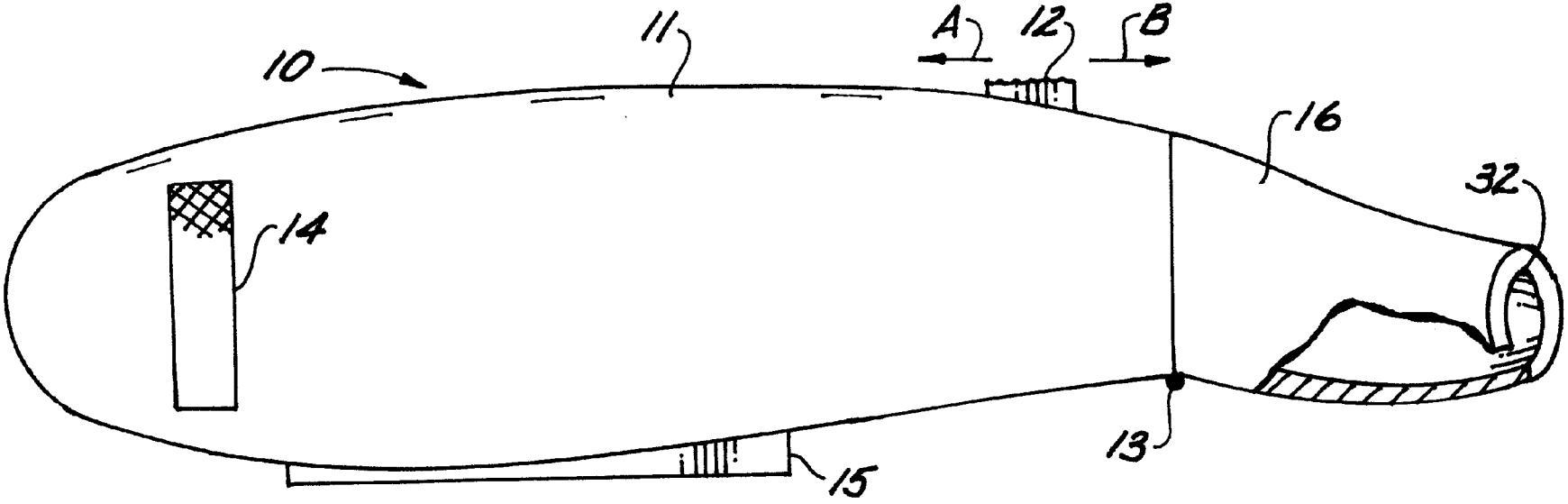
FIG. 1 is a side elevation view illustrating a lint vacuum cleaner constructed in accordance with the principles of the invention.
Figure 2:
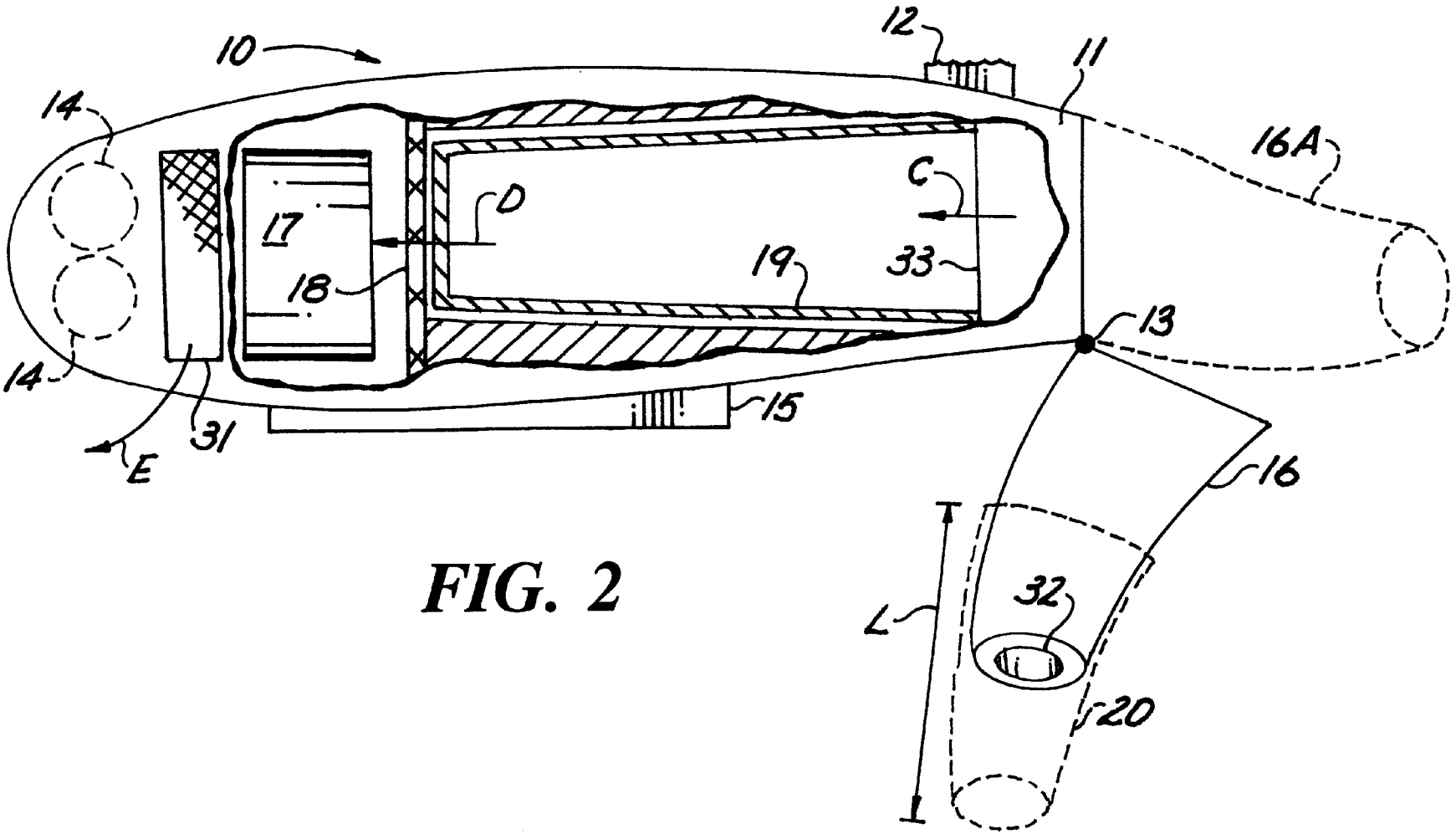
FIG. 2 is a side break-away view of the lint vacuum cleaner of FIG. 1 illustrating further internal constructions details thereof.
Figure 3:
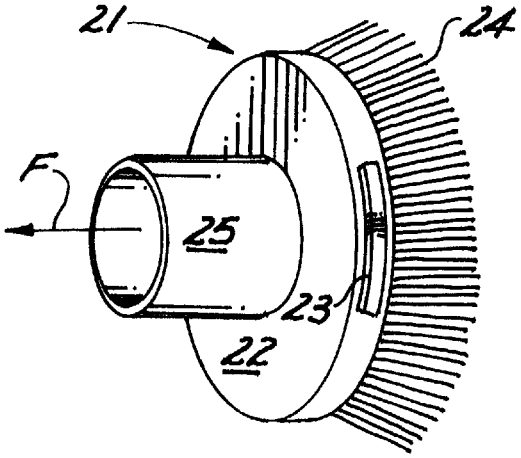
FIG. 3 is a perspective view illustrating a brush fitting utilized in accordance with the invention; and, FIG. 4 is a side view of a cleaning brush and spoon utilized in conjunction with the lint vacuum cleaner of FIG. 1.
Figure 4:
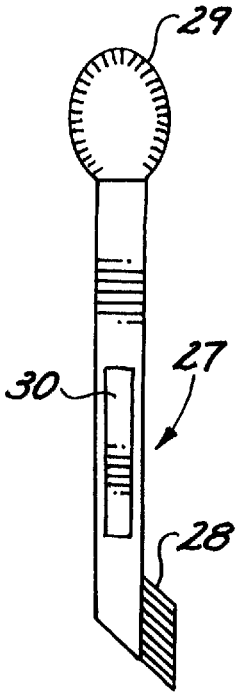

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a lint vacuum cleaner including an elongate hollow arcuate housing 10 having a circular open end. Nose 16 is pivotally attached to the circular open end of housing 10 by hinge 13. In FIG. 1, nose 16 is snapped into its normal closed operating position. In FIG. 2, nose 16 has been snapped open and pivoted about hinge 13 such that an air permeable paper lint collection bag 19 can be inserted in or removed from the housing 10. The normal operative position of the lint collection bag 19 is shown in FIG. 2.

Fan 17 is operated by moving switch 12 in the direction of arrow A when turning fan 17 (and vacuum cleaner 10) on and in the direction of arrow B when turning fan 17 (and vacuum cleaner 10) off. Batteries 14, preferably rechargeable batteries, power fan 17. When fan 17 is on, it draws air in through nose 16 and into bag 19 in the direction of arrow C, through the bottom of bag 19 into fan 17 in the direction of arrow D, through fan 17, and out through exhaust vent 31 in the direction of arrow E. Magnet 15 enables the lint vacuum cleaner 10 to be removably secured to the side or top of many conventional clothes dryers.

The diameter of circular distal opening 32 of nose 16 is at least one-half inch, preferably at least three-quarters of an inch, and most preferably at least one inch. An opening 32 which at its narrowest width is less than one-half of an inch wide is not preferred because of the matted nature of lint. Matted lint from a lint screen can plug openings which are one-quarter of an inch wide, even one-half or three-quarters of an inch wide. A one inch wide opening is less likely to be plugged by lint.

Nose 16 is preferably, but not necessarily, shaped such that it can be placed completely into the lint screen recess in a dryer and contact and be pulled along the bottom of the lint screen to suction lint through nose 16 into bag 19. A hollow extender piece, indicated by dashed lines 20 in FIG. 2, can be provided. Attachment 20 is removably press fit over nose 16 to extend the length of nose 16 (and, if necessary, to reduce or increase the width of the opening at the distal end of nose 16) to facilitate inserting nose into a lint screen recess which is deeper or wider than normal. Attachment 20 is preferably constructed of a soft flexible material like rubber and has a length L in the range of six inches to eighteen inches. If desired, the length of nose 16 can be in the range of one to eighteen inches. Vacuum cleaner 10 appears especially practical when the width of the distal end of nose 16 is about equal to the width of the lint screen in a clothes dryer.

Hollow neck 25 of brush 21 is also sized to be removably press fit over the distal end of nose 16 in the same manner than extender piece 20 is press fit over nose 16 in FIG. 2. When brush 21 is press fit over the distal end of nose 16 and fan 17 is turned on, air is drawn through brush bristles 24 and hollow neck 25 in the direction of arrow F and into bag 19. Magnet 23 permits brush 21 to be magnetically secured to the side of many conventional clothes driers.

Cleaning tool 27 includes a brush 28 and spoon 29 which can be utilized to loosen and remove lint from a lint screen in a clothes dryer. Magnet 30 can be used to removably secure tool 27 to the side or top of many conventional clothes dryers.

In use, nose 16 is opened to the position shown in FIG. 2 and an air permeable disposable paper bag 19 is inserted inside housing 10 in the position shown in FIG. 2. Nose 16 is closed to the position shown in FIG. 1. Button 12 is pressed in the direction of arrow A to turn on fan 17. The door of a clothes dryer is opened. Body 11 is manually grasped and nose 16 is inserted in the recessed lint screen. Nose 16 is moved back and forth along the lint screen to draw lint through nose 16 into bag 19. Vacuum 10 is moved to withdraw nose 16 from inside the recessed lint screen. Body 11 is moved to draw nose 16 around the outer edge of the lint screen to capture loose lint. Switch 12 is moved in the direction of arrow B to turn off fan 17. Vacuum 10 is set aside. Tool 27 is manually grasped. Brush 28 is moved over the lint screen to free lint from the lint screen. The lint screen is scrapped with spoon 29 to remove lint. If necessary vacuum 10 is again turned on and nose 16 is inserted in the recessed lint screen to remove excess lint.

Some conventional lint screens are one or more inches deep and are not very wide, having an opening width of about an inch. Other lint screens have a wider opening and may be shallower. The vacuum 10 of the invention is especially useful in connection with narrower, deeper recessed lint screens.

In one embodiment of the invention, bag 19 is not utilized and fan 17 draws lint against screen 18. When a sufficient quantity of lint gathers against screen 18, nose 16 is opened and the lint is scrapped out of body 11. At least a portion of body 11 can be fabricated of a transparent plastic or other material such that a user can view the lint gathering inside body 11. The transparent body can, if desired, enable a user to determine when lint needs to be removed from inside body 11. When a bag 19 is utilized, at least a portion of the body 11 can be made from a transparent material to enable a user to view the mouth 33 of bag 19 to determine when the bag 19 is filled with lint and needs to be removed from vacuum 10.

In another embodiment of the invention, bag 19 removably fits in and is utilized in conjunction with a perforated open-ended conical filter screen fabricated from a hard material like metal or plastic. The filter screen can have any desired shape, but preferably has a shape similar to that of bag 19, only slightly larger so that tapered bag 19 removably fits in and conforms to the filter screen. The filter screen conforms to and fits in body 11 in a manner similar to bag 19 in FIG. 2. The filter screen can be permanently or removably mounted in body 11. When bag 19 is filled with lint, nose 16 is opened and bag 19 (and the conical filter screen, if appropriate) is removed from within the conical filter screen. A clean bag 19 is placed inside of the conical filter screen such that fan 17 draws air through nose 16, through the clean bag 19, through the conical filter screen, and through fan 17 in the direction of arrow D.

Having described my invention and the presently preferred embodiments thereof in a manner understandable to those of skill in the art,

I claim:

1. A method for removing lint from a lint gathering recess of a clothes dryer setting on a floor, said method including the steps of:

a) providing a self-contained portable lint vacuum cleaner shaped and dimensioned to be manually held and utilized while above and spaced apart from the floor, said vacuum cleaner including
   (i) an elongate hand held housing;
   (ii) a nose attached to said housing and shaped and dimensioned to extend into the lint gathering recess to remove lint therefrom;
   (iii) air permeable collecting means mounted in said housing for capturing lint in said housing;
   (iv) an exhaust vent positioned in said housing;
   (v) fan means mounting in said housing for drawing air through said nose, into and through said air-permeable collecting means, and for directing exhaust air out through said exhaust vent;
   (vi) battery means mounted in said housing to power said fan means;
   (vii) switch means mounted in said housing to provide power to said fan means from said battery means to operate said fan means; and
   (viii) a first magnetic means attached to said housing for removably mounting said lint vacuum cleaner on the clothes dryer, said first magnetic means being free of any connection to an electrical outlet;

b) providing a cleaning means including a brush and spoon for removing lint from the lint gathering recess and a second magnetic means for removably mounting said cleaning means on the clothes dryer, wherein said cleaning means is manually manipulated separately from said vacuum cleaner;

c) utilizing said first magnetic means to removably mount said lint vacuum cleaner at a first storage location on the clothes dryer;

d) utilizing said second magnetic means to removably mount said cleaning means to a second storage location on the clothes dryer; and, e) when necessary,
   (i) removing said lint vacuum cleaner from said first storage location and utilizing said lint vacuum cleaner to free lint from the lint gathering recess, and
   (ii) removing said cleaning means from said second storage location and utilizing said cleaning means to free lint from the lint gathering recess of the clothes dryer.

2. The method of claim 1, further comprising, following step (e), the additional step of remounting said lint vacuum cleaner at said first storage location on the clothes dryer.

* * * * *